US006793428B2

(12) United States Patent
Lithgow

(10) Patent No.: US 6,793,428 B2
(45) Date of Patent: Sep. 21, 2004

(54) DRYWALL JOINT COMPOUND APPLICATOR APPLIANCE

(76) Inventor: Kevin J. Lithgow, 4725 Lyndale Ave. South, Minneapolis, MN (US) 55409

( * ) Notice: Subject to any disclaimer, the term of this patent is extended or adjusted under 35 U.S.C. 154(b) by 0 days.

(21) Appl. No.: 10/773,626

(22) Filed: Feb. 5, 2004

(65) Prior Publication Data

US 2004/0161283 A1 Aug. 19, 2004

Related U.S. Application Data

(63) Continuation-in-part of application No. 09/941,977, filed on Aug. 29, 2001, now abandoned
(60) Provisional application No. 60/229,459, filed on Sep. 1, 2000.

(51) Int. Cl.[7] ..... A46B 11/00; A46B 11/02
(52) U.S. Cl. ..... 401/48; 401/187; 401/188 R; 222/175; 222/389
(58) Field of Search ..... 401/48, 176, 188 R, 401/187; 222/175, 389, 399; 118/200, 201, 695; 239/337

(56) References Cited

U.S. PATENT DOCUMENTS 3,945,571 A * 3/1976 Rash ..... 239/152
4,648,431 A * 3/1987 Strongert et al. ..... 141/18
5,863,146 A * 1/1999 Denkins et al. ..... 401/188 R
5,878,925 A * 3/1999 Denkins et al. ..... 222/608
5,882,691 A * 3/1999 Conboy ..... 425/87

* cited by examiner

*Primary Examiner*—David J. Walczak
(74) *Attorney, Agent, or Firm*—Gray, Plant, Mooty, Mooty & Bennett, P.A.; Robert W. Gutenkauf

(57) ABSTRACT

A wall compound applicator appliance that has a work station including a reservoir for containing a supply of wall compound, an air compressor, an applicator tool, a portable compressed air tank to operate the applicator tool, and a carrying strap assembly to attach the tank to a user with the tank connected to the applicator tool. The applicator tool has a cylindrical, tubular body to receive a supply of wall compound. The reservoir has a transport tube that is connectable to a one-way fill valve on the applicator tool to refill the applicator tool with wall compound. An adapter is connected to the work station and has a fitting to connect to a refill airline that is connected to the portable compressed air tank in order to refill the tank at the same time that the applicator tool is being refilled. Once the applicator tool and the compressed air tank are refilled, the workman is free to move about the work area independent of a work station and the air compressor.

7 Claims, 7 Drawing Sheets

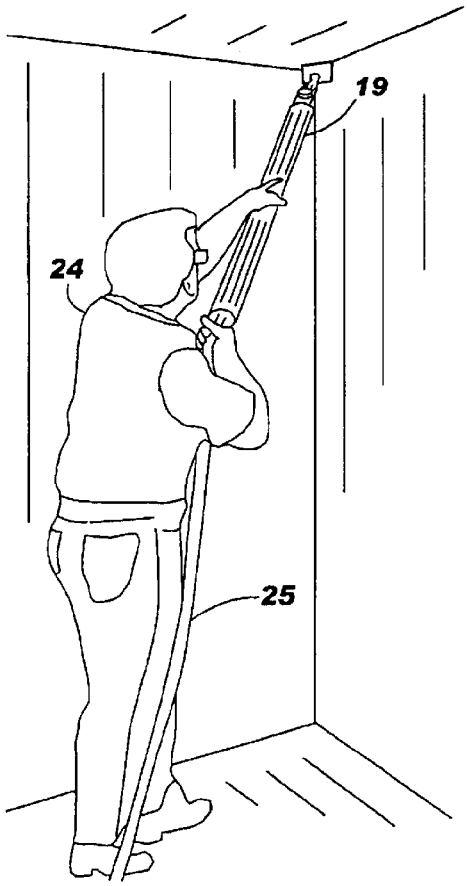
FIG. 3
Prior Art
FIG. 7
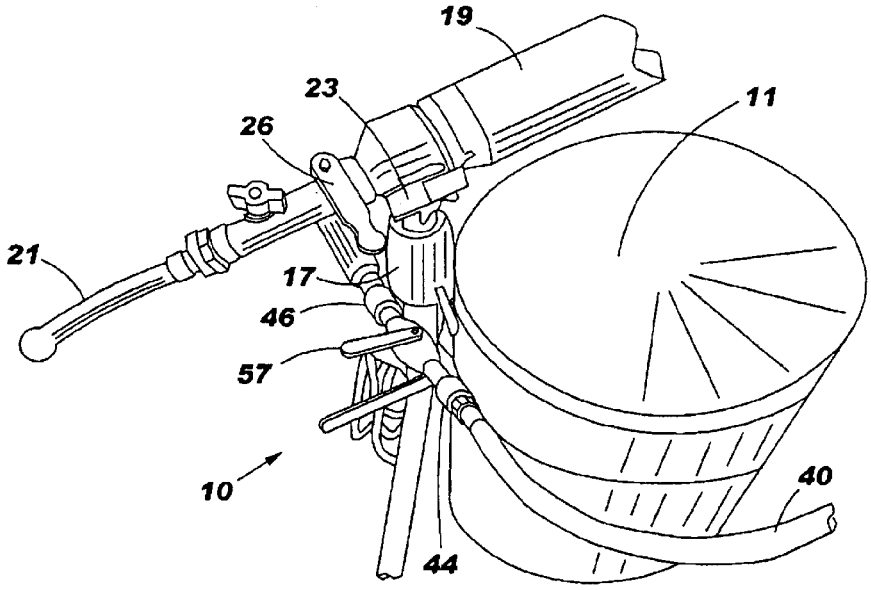

DRYWALL JOINT COMPOUND APPLICATOR APPLIANCE

CROSS REFERENCE TO RELATED APPLICATIONS

This application is a continuation-in-part of U.S. application Ser. No. 09/941,977 filed Aug. 29, 2001, now abandon which application claims the benefit of provisional application Serial No. 60/229,459, filed Sep. 1, 2000.

BACKGROUND OF THE INVENTION

Drywall finish coating, or the application of joint compound to taped seams, is tedious when done manually. Drywall joint compound applicator tools are available to ease this task. Examples of such tools are shown in U.S. Pat. No. 5,863,146 to Denkins, et al. (Denkins I), issued Jan. 26, 1999 and in U.S. Pat. No. 5,878,925 to Denkins, et al. (Denkins II), issued Mar. 9, 1999, both of which are incorporated herein by reference. The Denkins I tool for applying joint compound has a hollow tubular storage body connected to a compressed air supply and a plunger longitudinally movable within the body. Joint compound fills the body. The compound is introduced into the tubular body through a one-way fill valve ahead of the plunger. Compressed air pushes the plunger forward to move the compound supply out through an applicator tip at a discharge end of the tool. The applicator tip retains any of a variety of attachment tools. A compressed air inlet fixture is at the opposite or air inlet end of the tube. An air compressor supplies pressurized air to the Denkins I storage body through the inlet fixture.

The Denkins II appliance includes a tool for applying joint or drywall compound, such as that shown in Denkins I, along with a joint or drywall compound supply reservoir for holding a supply of compound. A pump moves the compound from the supply reservoir through the hollow tubular storage body of the applicator tool to refill the tool with compound. A compressed air manifold attaches to the supply reservoir and connects to an air compressor. An air line connects to the applicator tool to provide it. Compressed air serves as the motive force to move the compound through the tool body to the applicator tip. The manifold has a number of attachment ports to permit simultaneous attachment of a number of applicator tools.

The air line connecting the applicator tool to the compressed air port on the supply reservoir can be problematic. The worker is tethered to and limited by the large stationary air compressor. This limits the mobility of the worker. The worker may become fatigued or entangled, attempting to move the heavy and cumbersome lines, the reservoir or the air compressor closer to a remote work site. When more than one tool is in use, there is a possibility of the lines becoming entwined or knotted.

SUMMARY OF THE INVENTION

The invention relates to a novel joint or drywall compound applicator appliance having a workstation with a reservoir for containing the joint or drywall compound, an air compressor, an applicator tool, a portable compressed air tank to operate the applicator tool, and a carrying strap assembly to attach the tank to a user with the tank connected to the applicator tool. The applicator tool has a cylindrical, tubular body to receive a supply of wall compound. Compressed air from the compressed air tank operates the applicator tool. The applicator tool has a nozzle at a discharge end of the tube and a compressed air fitting at the air inlet end. The portable tank is held by a carrying strap assembly so that the worker can carry the tank and applicator tool from place to place to perform the joint or drywall finishing projects. The worker moves about free of constraints as might otherwise be imposed by dragging around an air supply line connected to air compressor. A novel adaptor of the invention is connected to the workstation and is used in one-stop refilling of the compressed air tank while the applicator tool is being refilled with compound.

BRIEF DESCRIPTION OF THE DRAWINGS

FIG. 3 shows a worker using the applicator appliance of FIG. 2 applying joint or drywall compound to a wall;

FIG. 7 shows the applicator tool connected to the supply reservoir of the applicator appliance;

DETAILED DESCRIPTION OF THE INVENTION

Figure 1:
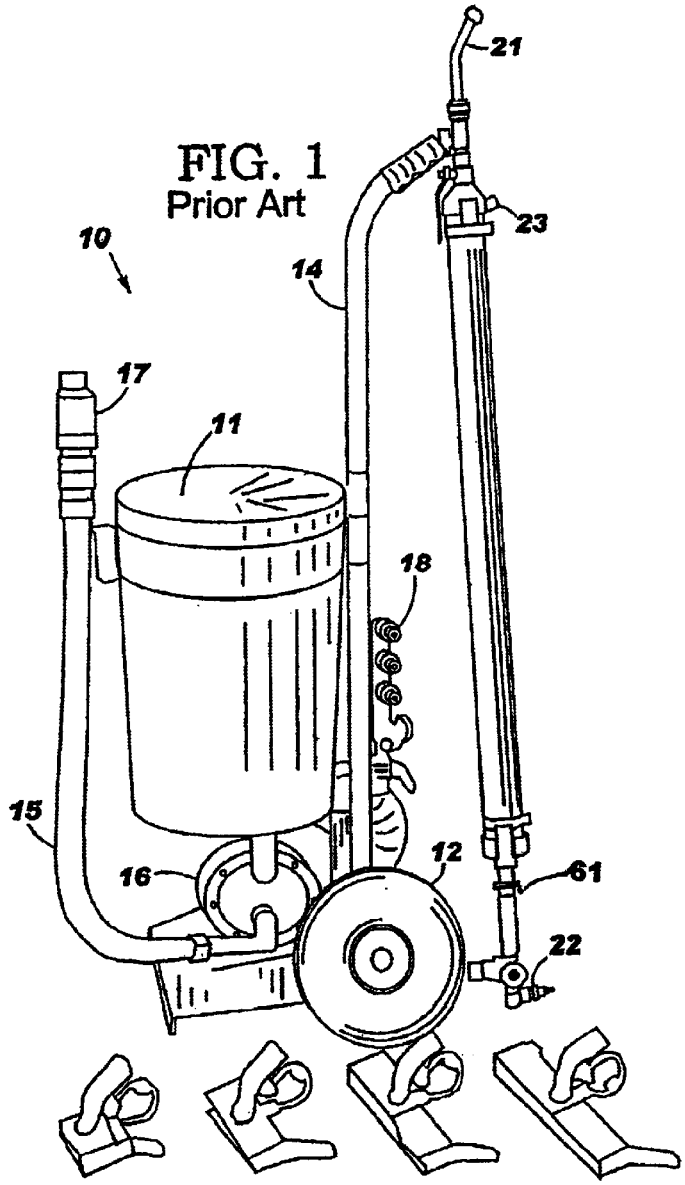
FIG. 1 Prior Art
FIG. 1 shows a commercial embodiment of a portable wall compound applicator appliance of the prior art.
Figure 2:
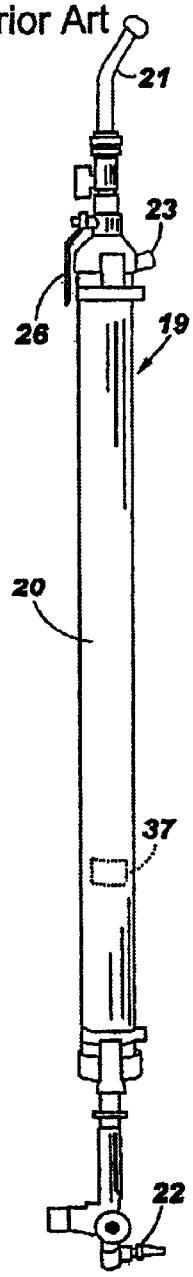
FIG. 2 Prior Art
FIG. 2 shows in greater detail the applicator tool of the applicator appliance of FIG. 1.

FIGS. 1 through 3 show prior art applicator equipment. FIG. 1 shows an applicator appliance that includes a workstation 10 having a joint or drywall compound canister or reservoir 11 mounted on a wheeled cart 12 having a handle 14. A transport tube 15 connects through a pneumatically-driven suction-type diaphragm pump 16 to the bottom of the reservoir 11. A fill attachment nozzle 17 is located at the top of the transport tube 15 connected near the top of reservoir 11.

A compressed air manifold 18 is connected to the workstation and has a plurality of pressure ports. The manifold 18 connects to an air compressor (not shown in FIGS. 1–3). An applicator tool or gun 19, connectable to a pressure port, hangs for storage on the handle 14 of the cart 12. FIG. 2 shows the conventional applicator tool 19 in greater detail. The applicator tool 19 has an elongate hollow barrel tube 20 with an applicator nozzle 21 at a discharge end of the tube 20. A one-way fill valve 23 is between the tube 20 and the applicator nozzle 21. The fill valve 23 opens to the interior of the tube 20 for filling the tube 20 with joint or drywall compound from the reservoir 11. Fill valve 23 may be any of a variety of commercially available one-way fill valves, such as a poppet valve or a ball and seat valve. Fill valve connects to the fill attachment nozzle 17 on transport tube 15 for refilling applicator tool 19. The applicator nozzle 21 can retain any of a variety of attachment tips such as those illustrated schematically in FIG. 1. An open/shut valve 26 is connected between nozzle 21 and tube 20. Valve 26 is closed when tube 20 is being filled through one-way valve 23, and is open during normal operation of the applicator tool 19.

The opposite or air inlet end of the tube 20 carries a compressed air fitting 22 for connection to a quick release pressure fitting on a compressed air line. A plunder assembly 37 is installed inside of the tube 20. Compressed air moves the plunger to force compound contained in the tube 20 out of the applicator nozzle 21.

FIG. 3 shows a worker 24 holding the applicator tool 19 in the procedure of applying joint or drywall compound to a wall. An air line 25 connects the applicator tool 19 to one of the compressed air ports on the compressed air manifold 18. The presence of the air line 25, which may extend more than several feet from the reservoir 11 to the applicator tool 19, limits and hinders the, movement of the worker 24. Typically, the work site encountered by a dry wall worker 24 is encumbered with a variety of objects that may easily entangle an air line 25 of such length. The air line 25 itself may become nicked and frayed from dragging across a crowded work site, requiring early replacement. The long air line 25 may entangle or pull over equipment requiring down time for clean up or even expensive repairs. The entangling air line 25 can endanger workers themselves. In actual use situations, entanglement of the air line 25 has led to breakage of vital components of the conventional applicator 19, such as pressure relief valve 62.

Figure 4:
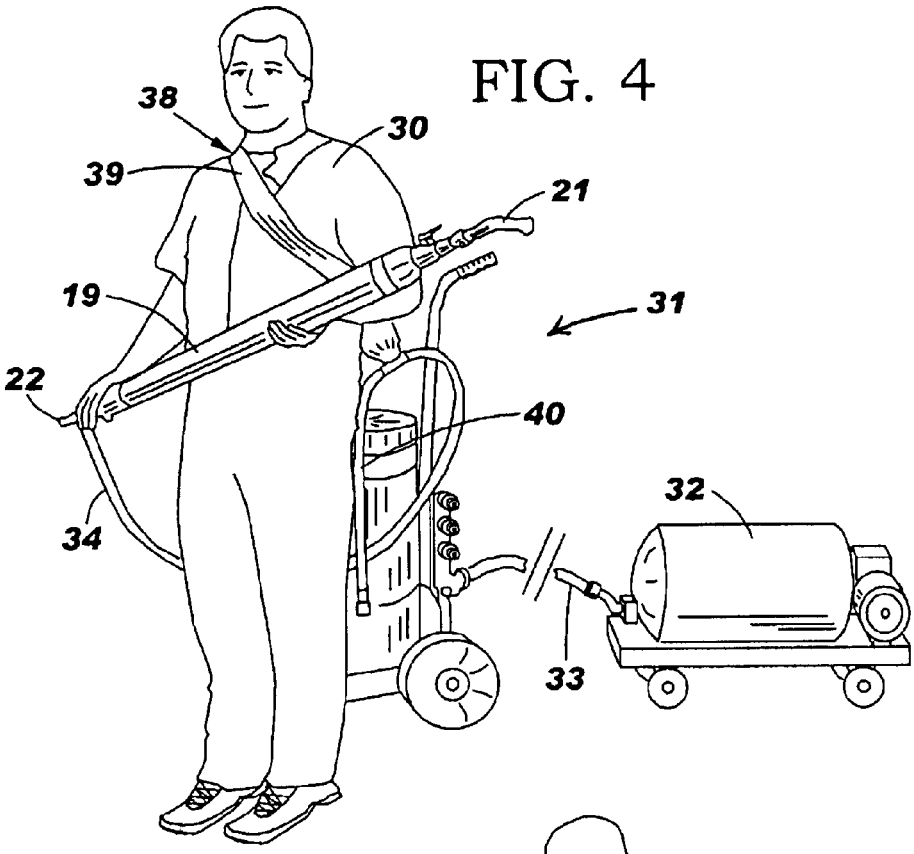
FIG. 4 is a facing view of a worker holding an applicator appliance according to the present invention.
Figure 5:
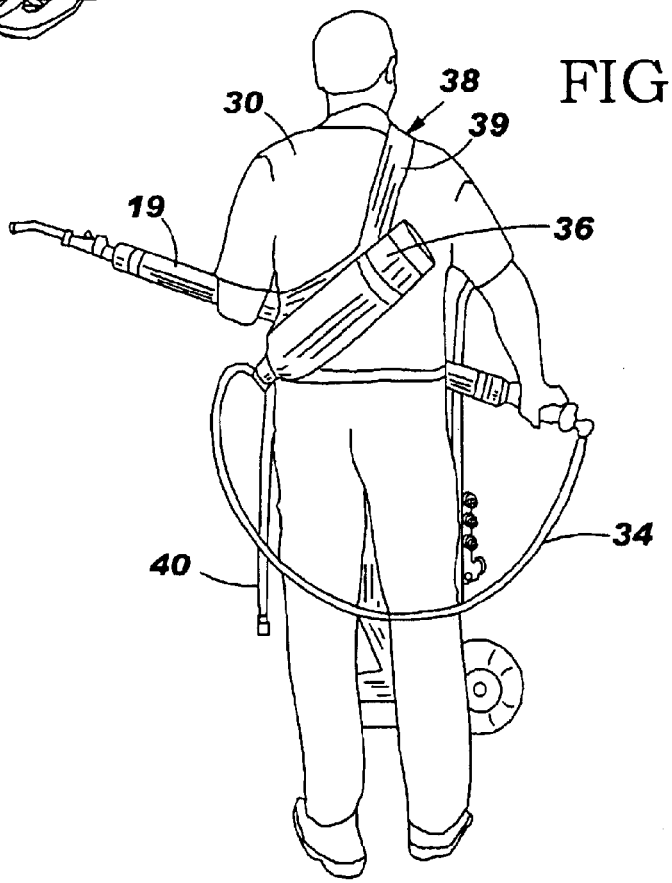
FIG. 5 is a rear view of the worker and applicator appliance of FIG. 4.

FIGS. 4 and 5 show an applicator appliance according to the invention indicated generally at 31 having certain components in common with the prior art appliance as will be illustrated through the use of common reference characters. The applicator appliance includes a work station 10 as previously described, and an air compressor 32 connected to the manifold 18 by a compressed air output line 33. Another worker 30 carries an applicator tool 19 powered by a small, lightweight portable, refillable air tank 36. A first compressed air line 34 connects to the compressed air fitting 22 of the applicator tool 19. The opposite end of the compressed air line 34 operatively connects to compressed air tank 36. The worker 30 carries the tank 36 supported on his back and/or waist in an out-of-the-way location. Tank 36 is carried by means of a strap assembly 38. A second compressed air line or refill air line 40 extends from the portable compressed air tank 36 for use in refilling the tank 36 as needed. Air line 40 can hang freely when not in use. Tank 36 provides compressed air to the tool 19 to move the plunger (indicated at 37 in FIG. 6) in body 20 to move compound through the nozzle as previously described. As shown in FIGS. 4 and 5 the worker 30 moves around and performs work independent of the location of the air compressor 32 or the workstation 10, returning to the workstation 10 only periodically to refill the applicator tool 19 and the compressed air tank 36 at the same time.

Figure 6:
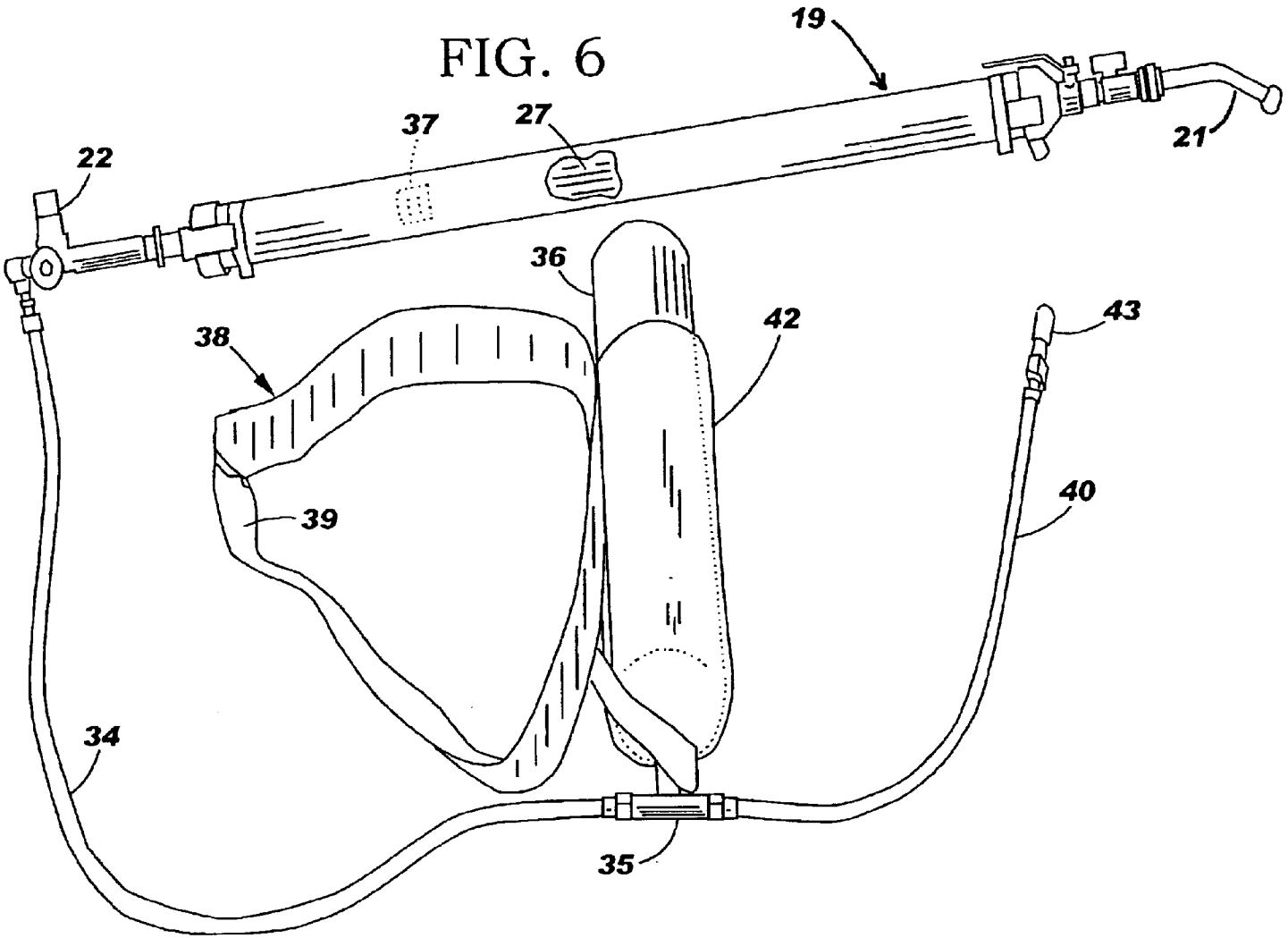
FIG. 6 is a plan view of the applicator tool assembly of the applicator appliance of the invention.

FIG. 6 shows in plan view the applicator tool 19 connected to air tank 36. Applicator tool 19 carries a charge of wall compound 27. The applicator tool 19 connects at the compressed air fitting 22 to the first compressed air line 34. A T-fitting 35 is secured to the end opening of tank 36. The refill air line 40 is connected at one end to one leg of the T-fitting 35. The other end of the refill air line has a quick disconnect pressure connector 43 (the type that is closed when unconnected to another pressure connector but that opens when connected to a mating pressure connector). The first air line 34 is connected to the other leg of the T-fitting. The carrying strap assembly 38 holds the tank 36 for carrying on the body of the worker 30. The strap assembly includes a shoulder strap 39 worn over the shoulder of the worker. A tank carrying pouch 42 is connected to the shoulder strap 39 and is positioned to locate the tank on the back of the worker in an inverted position.

FIG. 7 shows the applicator tool 19 docked at the supply canister or reservoir 11 at workstation 10 for refilling of both the applicator tool 19 and the portable compressed air tank 36. The worker 30 desirous of filling the applicator tool 19 with compound and the portable air tank 36 with compressed air, proceeds as follows. The fill valve 23 on the applicator tool 19 is connected to the fill attachment nozzle 17 on the transport tube 15 (for example, according to the description in Denkins I and II). Pump 16 is actuated. The fill valve 23 opens against the pressure of oncoming compound delivered by diaphragm pump 16 from the reservoir 11. Incoming compound moves the piston rearward in the tube or toward the air inlet end. At the same time, the pressure connector 43 of refill air line 40 connects to the adaptor 29 attached to reservoir 11. The adaptor 29 can be attached to the side of the reservoir 11 proximate the compound fill attachment nozzle 17. The worker turns the adapter control valve 57 to fill the tank 36. The portable compressed air tank 36 and the tube 20 refill in roughly the same amount of time, whereupon the worker 30 closes the valves 57 and 26, respectively, and returns to work.

Figure 8:
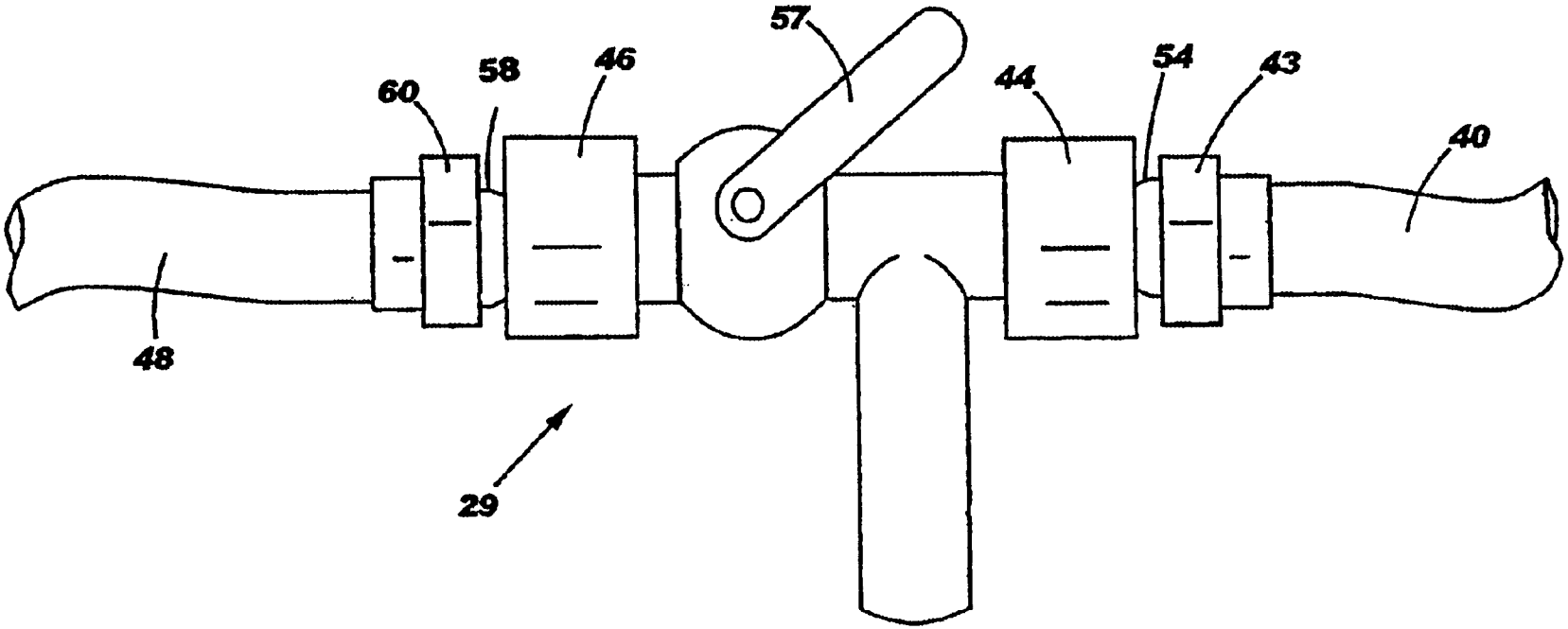
FIG. 8 is a schematic view of the adaptor of the invention.

FIG. 8 shows the adaptor 29 in greater detail. The adaptor 29 includes a first air line pressure connector 44 for connection to the refill air line 40 to fill the portable compressed air tank 36. Suitably, the fitting 44 may include a male compressed air connector 54 for operative connection to a female connector 43 on second air line 40. The control valve 57 operates to open and close passage of compressed air through the adaptor 29. A refill air line connector fitting 46 connects to a supply air line 48 that extends to the manifold 18 and connects to one of the air ports thereon. Suitably, the fitting 46 also includes a male compressed air connector 58 for operative connection to a female compressed air connector 60 on the supply air line 48.

After using the adaptor 29 in filling tank 36, control valve 57 is closed and the refill air line 40 is disconnected from the adaptor 29. The worker 30 has accomplished the refill without removing the tank from his back or disconnecting the applicator tool and now can move freely about the work area independent of the location of the reservoir 11 and the air compressor 32.

Figure 9:
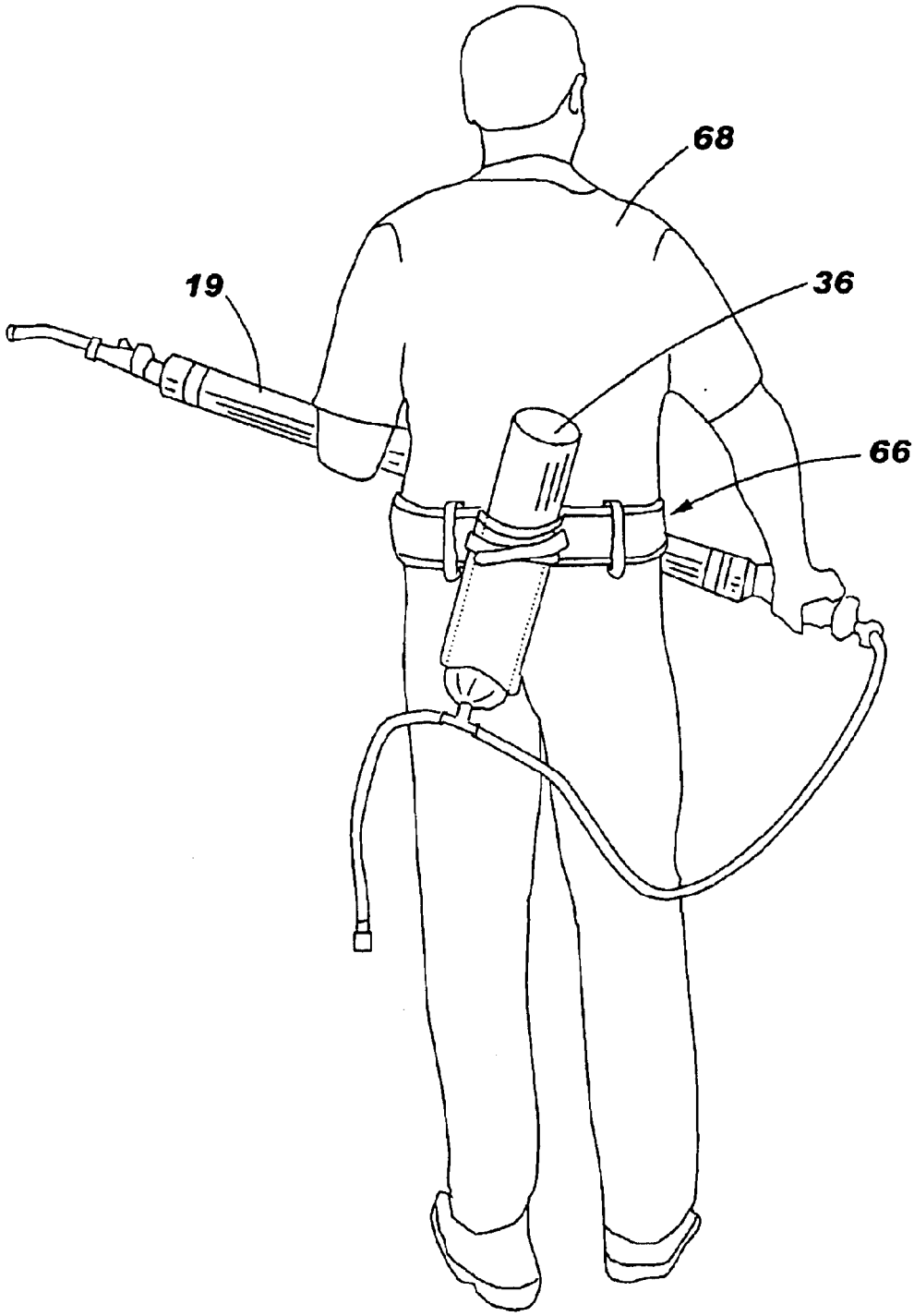
FIG. 9 is a rear view of a workman carrying a compressed air tank of the applicator appliance of the invention using a carrying strap assembly according to a second embodiment of the invention.
Figure 10:
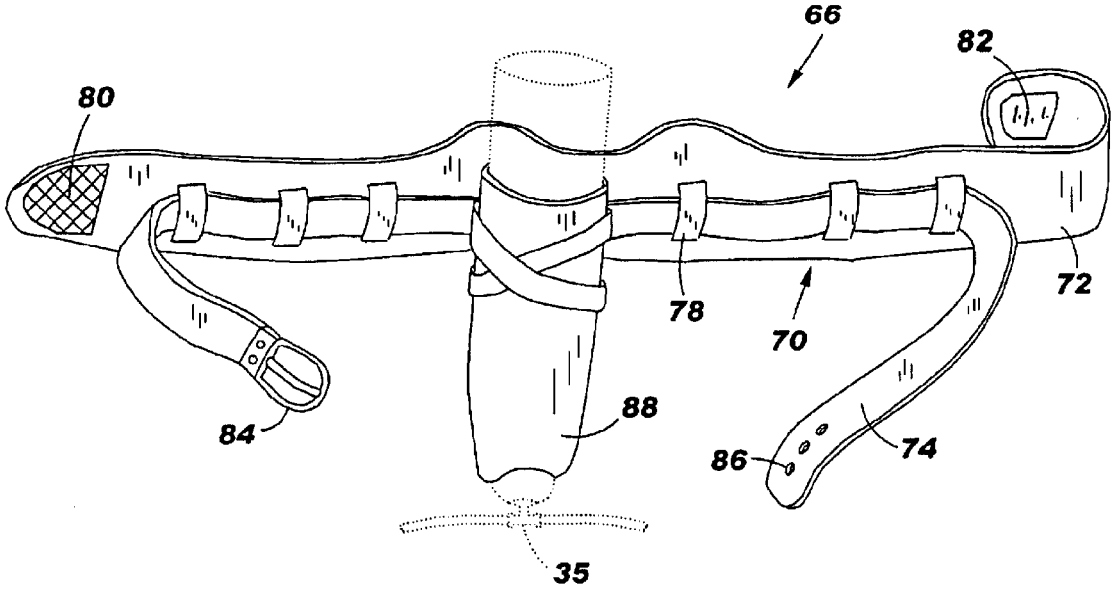
FIG. 10 is a plan view showing one side of the carrying strap assembly of FIG. 9.
Figure 11:
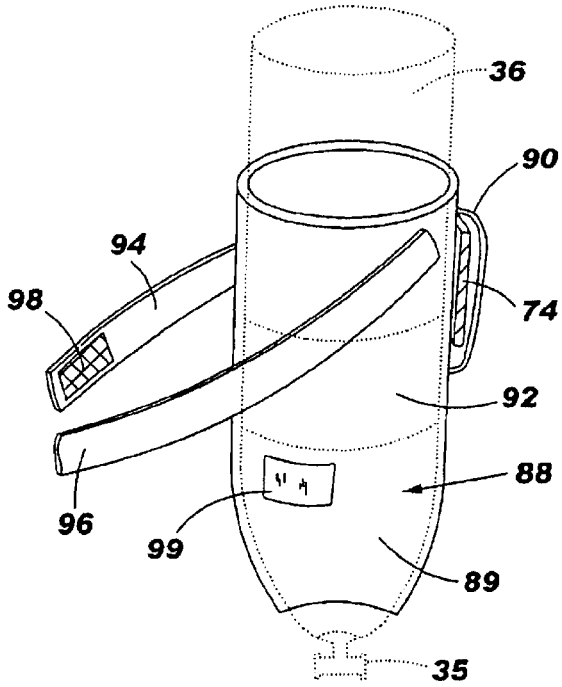
FIG. 11 is a plan view of the other side of the carrying strap assembly of FIG. 10.

FIGS. 9 through 11 show a second embodiment of a strap assembly indicated generally at 66 for use by a worker 68 to carry a portable air tank 36 to power the applicator tool 19. Strap assembly 66 is fitted about the waist of the worker and carries the tank 36 from the waist of the worker on the rear side of the worker. Strap assembly 66 is ergonomically advantageous permitting the worker to carry tank 36 with enhanced comfort and reduced fatigue. As shown in FIG. 10, strap assembly 66 includes a two-part work belt 70. A first part of the work belt 70 is a waist band 72 of sufficient length to wrap around the waist of the worker. The second part includes a belt 74. The belt 74 is trained through belt loops 78 on the waist band 72. The waist band 72 has at one end an outwardly facing pad 80 of hook and loop fastening material. The opposite end has an inwardly facing pad 82 of mating hook and loop fastening material. The waist band 72 is secured about the waist of the worker in conventional manner by circumventing the waist and attaching the attachment pads 80, 82. The waist band 72 is made of any conventional study material such as canvas or vinyl. One end of the belt 74 has a conventional buckle 84. The opposite end has holes or openings 86 for fastening the buckle 84. Once the waist band 72 is in place about the waist of the worker, the belt 74 is fastened around the outside of the waist band 72 for the comfort and safety of the worker.

Referring to FIGS. 10 and 11, a tank pouch 88 is connected to the two-part work belt 70. Tank pouch 88 has a sleeve or base 89 that is cylindrical and downwardly tapered so as to conform to the curvature of the end of a compressed air tank. The tank pouch 88 is conveniently fabricated from a sturdy material such as vinyl. A loop 90 is fastened to the tank pouch 88 so that a segment of the belt 74 can be trained through it to secure the tank pouch 88 to the work belt 70.

The compressed air tank 36 fits in the tank pouch 88 in inverted fashion as shown in FIG. 9 and in phantom in FIGS. 10 and 11. A central section 92 of the sleeve 89 of tank pouch 88 can be formed of elastic in order to hug the compressed air tank 36 and inhibit movement of it. In addition, support straps 94, 96 can be attached to the tank pouch 88 at fixed ends and have free ends that wrap around the tank pouch with the tank installed therein. Hook and loop-type fastening pads secure the fastening straps 94, 96 in place. As shown in FIG. 11, an inwardly facing fastening pad 98 on a strap 94 can connect to an outwardly facing fastening pad 99 located on the sleeve 89. The fastening pad 99 is located in a position that will cause the support strap 94 to be in tension when wrapped around the sleeve 89 with a tank 36 situated therein. Thereafter as shown in FIG. 9, the strap assembly 66 permits worker 68 to move about from place to place using the applicator tool 19 and comfortably carrying the compressed air tank 36.

The embodiments of the invention in which an exclusive property or privilege is claimed are defined as follows:

1. A wall compound applicator appliance comprising:

a work station having a compound supply reservoir for storing a supply of compound, a transport tube connected at one end to the reservoir for filling an applicator tool with compound from the reservoir, a pump connected to the supply reservoir and the transport tube to move compound from the supply reservoir through the transport tube;

an applicator tool having a hollow tubular storage body with a discharge end and an air inlet end, an applicator tip at the discharge end and a compressed air inlet fitting at the inlet end;

a refillable, portable, compressed air tank with an air opening and a T-connector installed in the air opening;

an air delivery air line connected at a first end to one leg of the T connector and an air refill air line connected at a first end to the opposite end of the T connector;

said air delivery line connected at a second end to the inlet fitting on the inlet end of the applicator tool;

a carrying strap assembly that can be worn by a worker and releasably connectable to the tank with the air delivery line connected to the tank so that the worker can carry the tank and the applicator tool from place to place to perform work;

said work station including a compressed air manifold;

an air compressor;

said air compressor connected to the compressed air manifold to deliver compressed air to the compressed air manifold;

an adapter connected to the work station;

said adapter having a supply line connected to the compressed air manifold to receive compressed air through the compressed air manifold;

said adapter having a fixture for releasable connection to a second end of the refill air line;

said adapter having a manually operable valve movable between a closed position to block passage of air through the adapter from the compressed air manifold and an open position to permit passage of air from the compressed air manifold through the adapter outlet so that compressed air can be provided to the air refill air line to refill the compressed air tank when the air refill line is connected to the adapter;

said transport tube connected to the reservoir having a free end with a connector that connects with a one way fill valve on the applicator tool so that the applicator tool can be refilled with compound from the reservoir at the same time that the compressed air tank is being refilled with compressed air through the adapter.

2. The wall compound applicator appliance of claim 1 wherein:

said carrying strap assembly includes a shoulder strap to be worn over the shoulder of a work person, and a compressed air tank pouch connected to the shoulder strap so as to be positioned adjacent the back of the work person wearing the shoulder strap over the shoulder.

3. The wall compound applicator appliance of claim 2 wherein:

said air compressor manifold has a plurality of ports, including said supply line extending from one of said ports to the adapter.

4. The wall compound applicator appliance of claim 2 wherein:

said pump connected to the supply reservoir and the transport tube is a diaphragm pump operated pneumatically by the air compressor.

5. The wall compound applicator appliance of claim 1 wherein:

said carrying strap assembly includes a work belt to be worn about the waist of a worker, a sleeve for holding the tank, and an attachment loop connected to the sleeve and connectable to the work belt to enable the worker to carry the tank from the waist of the worker.

6. The wall compound applicator appliance of claim 5 wherein:

said work belt is a two-part work belt having a waist band as one part and a belt as the other part, said waist band having belt loops accommodating the belt, said attachment loop on the sleeve attached to the belt.

7. The wall compound applicator appliance of claim 6 wherein:

said waist band has ends with hook and loop attachment pads that can be fastened together when the waist band is positioned about the waist of a worker.

* * * * *